US009073199B2

(12) United States Patent
Hsieh

(10) Patent No.: US 9,073,199 B2
(45) Date of Patent: Jul. 7, 2015

(54) PIVOT HEAD WRENCH

(71) Applicant: KABO TOOL COMPANY, Taichung (TW)

(72) Inventor: Chih-Ching Hsieh, Taichung (TW)

(73) Assignee: KABO TOOL COMPANY, Taichung (TW)

( * ) Notice: Subject to any disclaimer, the term of this patent is extended or adjusted under 35 U.S.C. 154(b) by 365 days.

(21) Appl. No.: 13/748,612

(22) Filed: Jan. 24, 2013

(65) Prior Publication Data

US 2014/0202290 A1 Jul. 24, 2014

(51) Int. Cl.
*B25G 1/06* (2006.01)
*B25B 23/00* (2006.01)

(52) U.S. Cl.
CPC ..... *B25G 1/063* (2013.01)

(58) Field of Classification Search
CPC ..... B25G 1/063; B25B 23/0028
See application file for complete search history.

(56) References Cited

U.S. PATENT DOCUMENTS 6,000,302 A * 12/1999 Chiang ..... 81/177.8
6,186,034 B1 * 2/2001 Lamons ..... 81/177.9
6,295,898 B1 * 10/2001 Hsieh ..... 81/177.8
6,405,621 B1 * 6/2002 Krivec et al. ..... 81/177.9
6,886,429 B1 * 5/2005 Lee ..... 81/177.8
7,000,507 B1 * 2/2006 Lin ..... 81/177.9
7,131,356 B2 * 11/2006 Lin ..... 81/180.1
7,165,480 B2 * 1/2007 Lin ..... 81/177.9
7,174,815 B1 * 2/2007 Hsieh ..... 81/177.9
7,197,966 B1 * 4/2007 Hsieh ..... 81/177.9
D545,154 S * 6/2007 Lin ..... D8/28
7,509,893 B2 * 3/2009 Wu ..... 81/177.8
8,028,607 B2 * 10/2011 Lee et al. ..... 81/60
8,276,485 B1 * 10/2012 Chen ..... 81/177.8
8,850,932 B2 * 10/2014 Tsai ..... 81/177.8
2009/0000430 A1 * 1/2009 Wu ..... 81/177.8
2010/0300252 A1 * 12/2010 Tsai ..... 81/177.9
2011/0072941 A1 * 3/2011 Tsai ..... 81/177.8
2014/0090523 A1 * 4/2014 Hsieh ..... 81/177.9

* cited by examiner

*Primary Examiner* — David B Thomas
(74) *Attorney, Agent, or Firm* — CKC & Partners Co., Ltd.

(57) ABSTRACT

A pivot head wrench includes a handle, a head, a pivot pin, a linear motion mechanism and a lock mechanism. The pivot pin connects the handle and the head. The linear motion mechanism is disposed at the handle and includes a moving path, wherein the head is disposed in the moving path. The lock mechanism includes a groove and at least one protrusion, wherein one of the groove and the protrusion is disposed at the head while the other is disposed at the linear motion mechanism for engaging with each other, and the protrusion and the groove both are disposed in the moving path.

3 Claims, 5 Drawing Sheets

PIVOT HEAD WRENCH

BACKGROUND

1. Technical Field

The present disclosure relates to a hand tool. More particularly, the present disclosure relates to a pivot head wrench.

2. Description of Related Art

A wrench is a tool for tightening and loosening fasteners such as bolts and screws. A variety of wrenches are developed for satisfying different operating requirements. For example, a pivot head wrench has a pivot mechanism disposed between a handle and a head for allowing the head to rotate around the handle. Furthermore, the pivot head wrench also has a positioning mechanism for positioning the head thereof.

SUMMARY

According to an aspect of the present disclosure, a pivot head wrench includes a handle, a head, a pivot pin, a linear motion mechanism and a lock mechanism. The pivot pin connects the handle and the head. The linear motion mechanism is disposed at the handle and includes a moving path, wherein the head is disposed in the moving path. The lock mechanism includes a groove and at least one protrusion, wherein one of the groove and the protrusion is disposed at the head while the other is disposed at the linear motion mechanism for engaging with each other, and the protrusion and the groove both are disposed in the moving path.

According to another aspect of the present disclosure, a pivot head wrench includes a handle, a head, a pivot pin, a linear motion mechanism and a lock mechanism. The pivot pin connects the handle and the head. The linear motion mechanism is disposed at the handle and includes a track and a sliding block, wherein the track has an extending path, the sliding block is disposed on the track, and the head is disposed in the extending path. The lock mechanism includes a groove and at least one protrusion, wherein one of the groove and the protrusion is disposed at the head while the other is disposed at the sliding block for engaging with each other, and the protrusion and the groove both are disposed in the extending path.

BRIEF DESCRIPTION OF THE DRAWINGS

The disclosure can be more fully understood by reading the following detailed description of the embodiments, with reference made to the accompanying drawings as follows.

DETAILED DESCRIPTION

Figure 1:
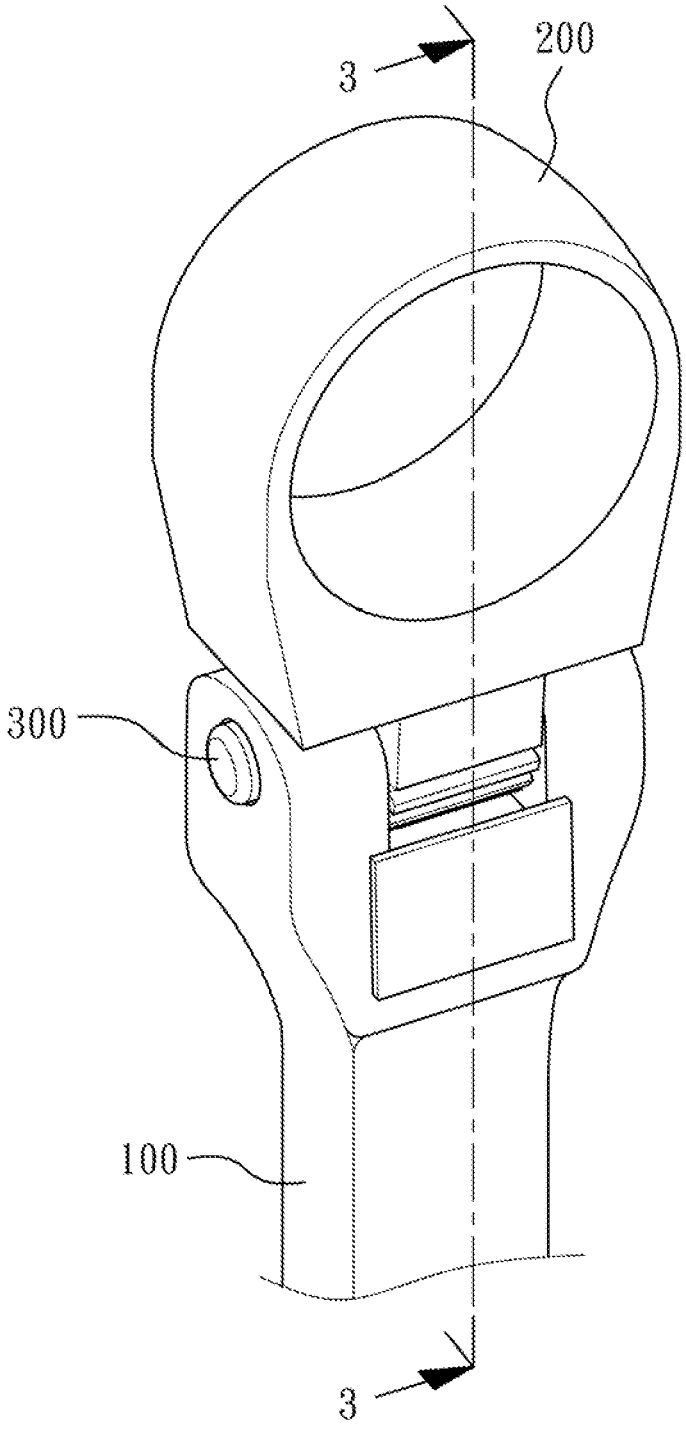
FIG. 1 is a perspective view of a pivot head wrench according to one embodiment of the present disclosure.
Figure 2:
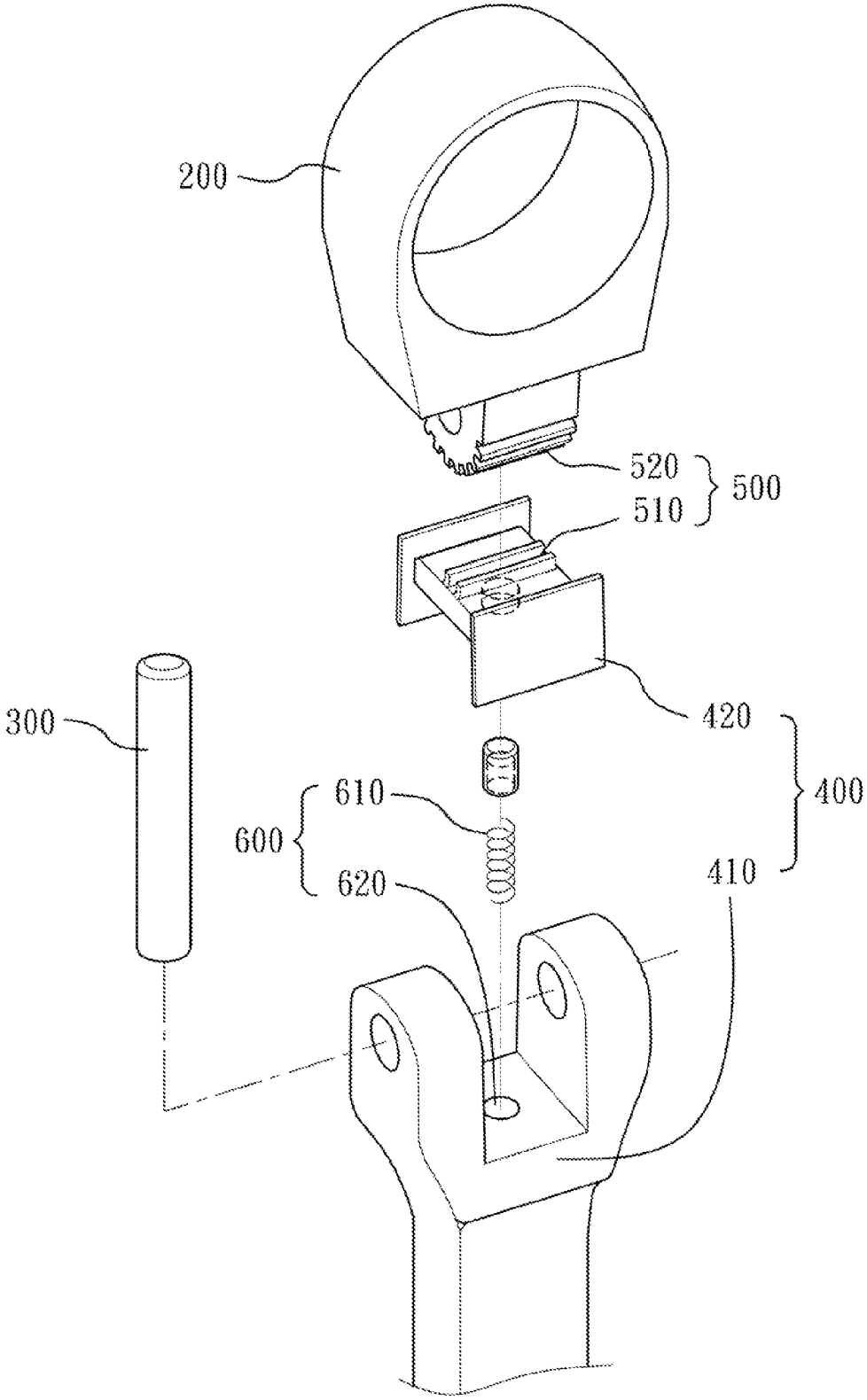
FIG. 2 is an exploded view of the pivot head wrench shown in FIG. 1.
Figure 3:
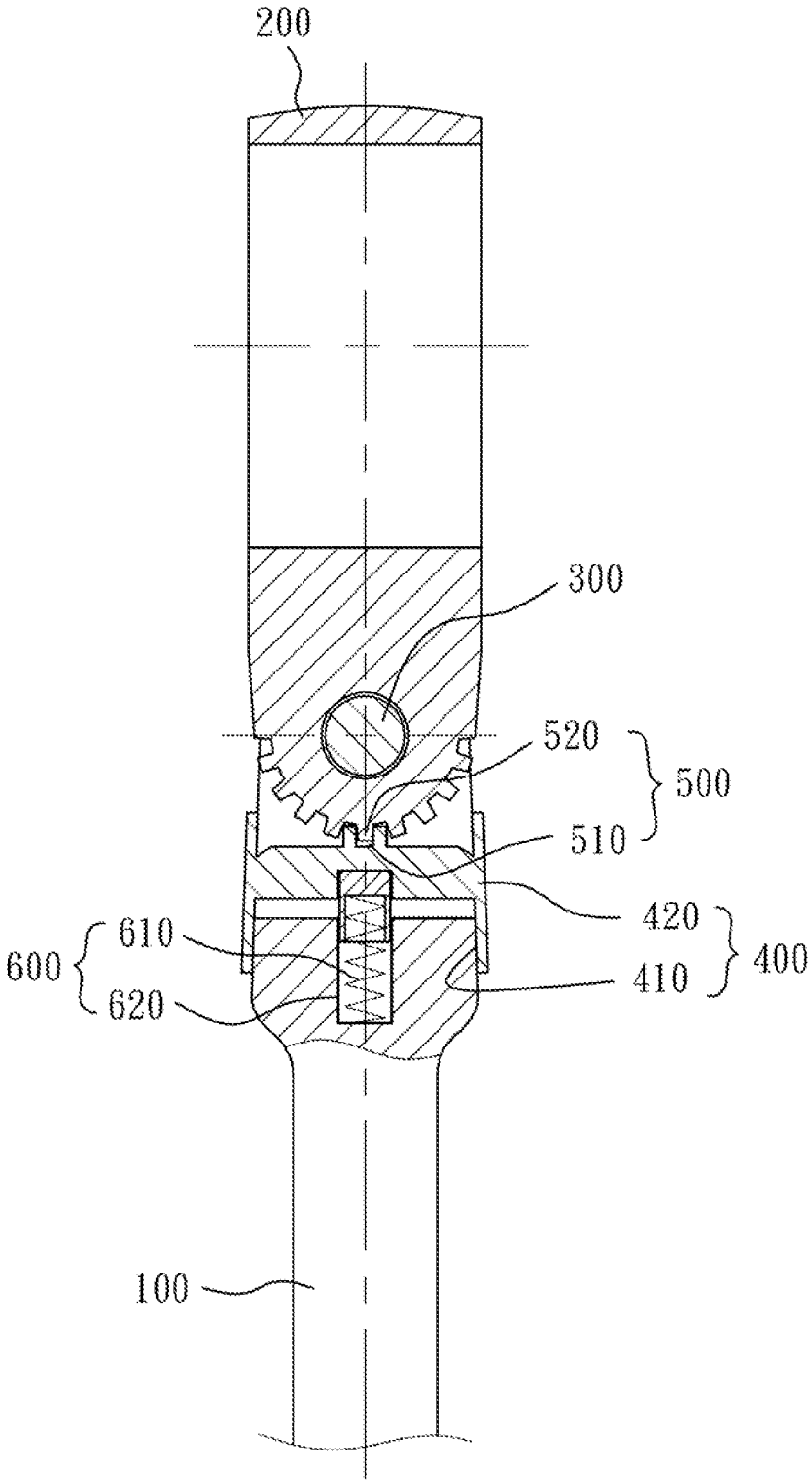
FIG. 3 is a cross-sectional view of the pivot head wrench along line 3-3 shown in FIG. 1.

FIG. 1 is a perspective view of a pivot head wrench according to one embodiment of the present disclosure. FIG. 2 is an exploded view of the pivot head wrench shown in FIG. 1. FIG. 3 is a cross-sectional view of the pivot head wrench along line 3-3 shown in FIG. 1. In FIG. 1 to FIG. 3, the pivot head wrench includes a handle 100, a head 200, a pivot pin 300, a linear motion mechanism 400 and a lock mechanism 500.

The pivot pin 300 connects the handle 100 and the head 200. The linear motion mechanism 400 is disposed at one end of the handle 100. The linear motion mechanism 400 includes a moving path, and the head 200 is disposed in the moving path. The lock mechanism 500 includes a groove 510 and a plurality of protrusions 520. The protrusions 520 are disposed at an end of the head 200, and the groove 510 is disposed at the linear motion mechanism 400. The plurality of protrusions 520 are configured for engaging with the groove 510. The plurality of protrusions 520 and the groove 510 are disposed in the moving path.

Figure 4:
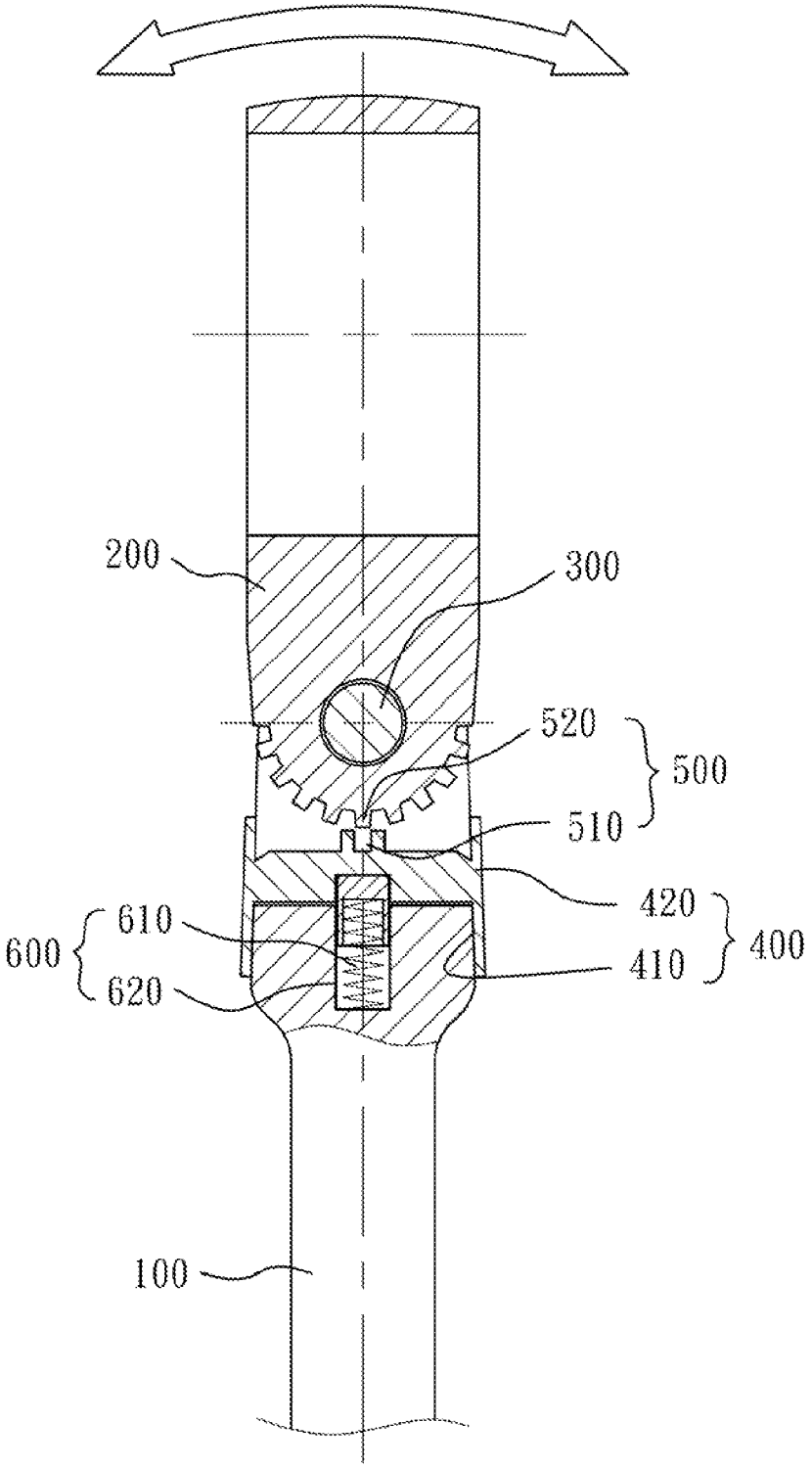
FIG. 4 shows a disengaging state of a groove and a protrusion of the pivot head wrench as illustrated in FIG. 3.

As shown In FIG. 3, one of the plurality of protrusions 520 engages with the groove 510 for positioning the head 200 at the handle 100. FIG. 4 shows a disengaging state of the groove 510 and the protrusion 520 of the pivot head wrench as illustrated in FIG. 3. In FIG. 4, the protrusion 520 disengages with the groove 510 by pushing the linear motion mechanism 400 against the handle 100, so that the head 200 can rotate relative to the handle 100.

Figure 5:
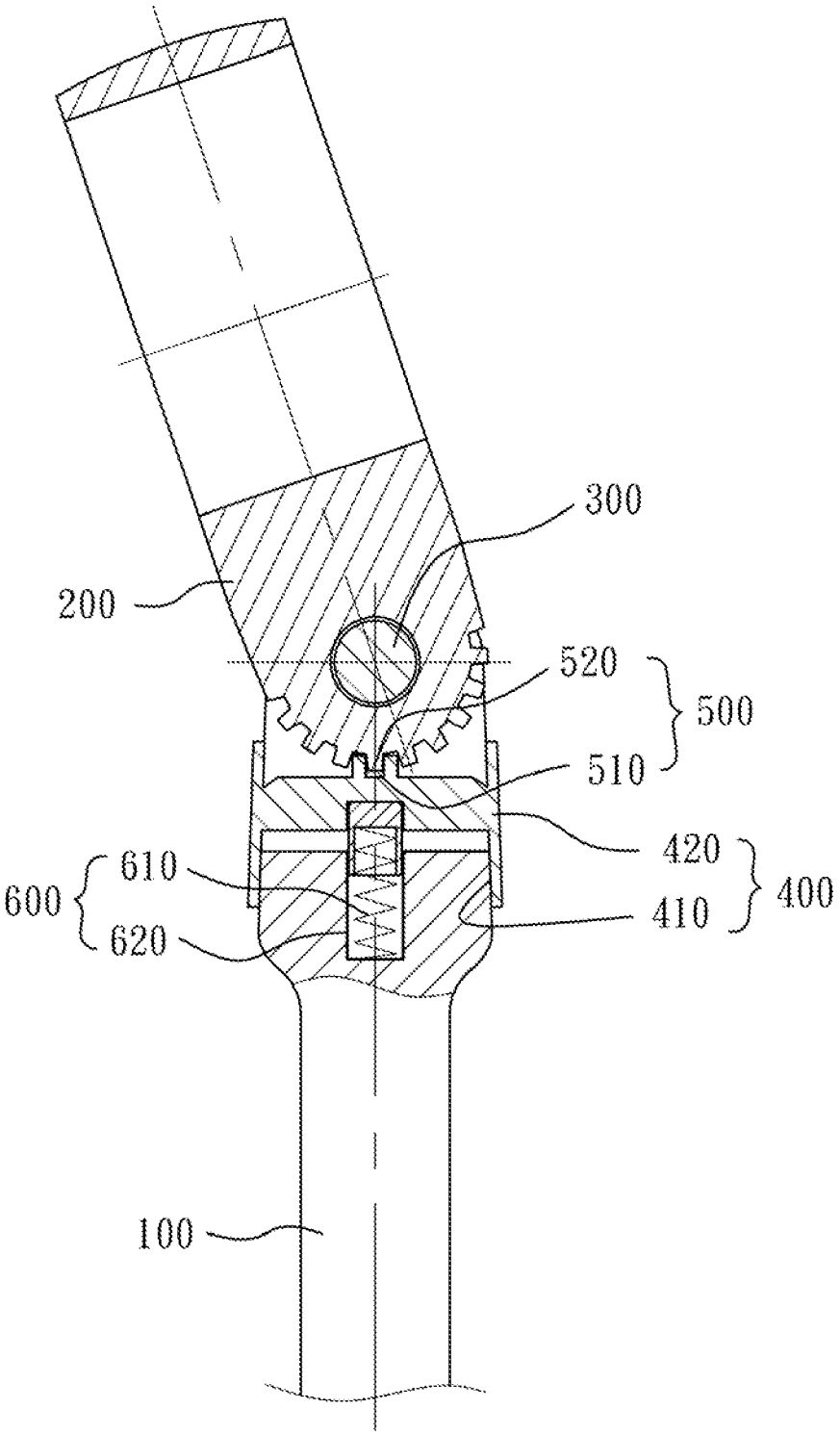
FIG. 5 shows an engaging state of the groove and another protrusion of the pivot head wrench as illustrated in FIG. 4.

FIG. 5 shows an engaging state of the groove 510 and another protrusion 520 of the pivot head wrench as illustrated in FIG. 4. When the groove 510 engages with the other protrusion 520, an angle between the head 200 and the handle 100 is changed accordingly. That means the angle between the head 200 and the handle 100 can be adjusted by engaging the groove 510 with a different protrusion 520. Therefore, the pivot head wrench can satisfy different operating conditions.

The groove 510 is in a rectangular shape, and the protrusions 520 are in a rectangular shape corresponding to the groove 510. When one of the protrusions 520 engages with the groove 510, a lateral external force is exerted on the lateral surfaces of the groove 510 and the lateral surfaces of the protrusion 520. The lateral surfaces of the groove 510 and the protrusion 520 are perpendicular to the lateral external force. Therefore, the lateral external force does not affect the engagement between the groove 510 and the protrusion 520. On the contrary, a pivot mechanism of conventional pivot head wrench usually has a groove and protrusions in a serrated shape. In the conventional case, when the groove engages with one of the protrusions, a lateral external force is exerted on the lateral surfaces of the groove and the lateral surfaces of the protrusion. The lateral surfaces of the groove and the protrusion are not perpendicular to the lateral external force. Therefore, a relative sliding motion between the protrusion and the groove occurs due to the lateral external force, and the protrusion and the groove are easily out of engagement. Apparently, the groove 510 and the protrusion 520 in a rectangular shape provide a better engagement effect.

Furthermore, the head 200, the protrusion 520 and the groove 510 are disposed in the moving path. That means the linear motion mechanism 400 moving along the moving path can decide weather the protrusion 520 engages with the groove 510 or not. Specifically, when the linear motion mechanism 400 moves away from the head 200 along the moving path, the protrusion 520 engages with the groove 510. When the linear motion mechanism 400 moves toward the head 200 along the moving path, the protrusion 520 disengages from the groove 510. More specifically, the direction of the moving path of the linear motion mechanism 400 is parallel to an extending direction of the handle 100.

The pivot mechanism of the conventional pivot head wrench has the groove and the protrusion in a serrated shape. Therefore, the protrusion can disengage from the groove via a rotating motion due to the serrated shapes of protrusion and the groove. It has the benefit of saving the occupied space of the pivot mechanism. However, the protrusion and the groove are easily out of engagement as mentioned above. When the pivot mechanism of the conventional pivot head wrench has the groove and the protrusion in a rectangular shape, the protrusion cannot rotate relative to the groove due to the rectangular shapes of protrusion and the groove, and thus the protrusion cannot disengage with the groove via a rotating motion. As shown in FIG. 4 and FIG. 5, the linear motion mechanism 400 enables the protrusion 520 in a rectangular shape to engage with or disengage from the groove 510 in a rectangular via a linear motion. Therefore, the pivot head wrench provides a better engagement effect than the conventional pivot head wrench.

Furthermore, when the direction of the moving path of the linear motion mechanism 400 is parallel to an extending direction of the handle 100, the linear motion mechanism 400 can move along the handle 100, and the pivot head wrench do not need an extra space for the linear motion mechanism 400. Therefore, the design of direction of moving path has the benefit of saving the occupied space of the linear motion mechanism 400.

The aforementioned term "linear motion mechanism" means a mechanism which can provides a linear motion. In FIG. 2, the linear motion mechanism 400 includes a track 410 and a sliding block 420. The track 410 is disposed at an end of the handle 100 and has an extending path. The head 200, the protrusion 520, and the groove 510 are disposed in the extending path, i.e., a direction of the extending path of the track 410 is parallel to an extending direction of the handle 100. The sliding block 420 is disposed on the track 410, and the groove 510 of lock mechanism 500 is disposed at the sliding block 420. The protrusion 520 can be engaged with or disengaged from the groove 510 by moving the sliding block 420 along the track 410.

Moreover, a reposition mechanism 600 is disposed in the handle 100 for providing the linear motion mechanism 400 a reposition force. The reposition mechanism 600 includes a spring 610 and a recess 620, wherein the recess 620 is disposed in the handle 100, and the spring 610 is accommodated in the recess 620. An end of the spring 610 cooperating with an abutting element (which is unnumbered) abuts against the sliding block 420 of the linear motion mechanism 400. When no external force is exerted on the sliding block 420, the spring 610 pushes the sliding block 420 against the head 200. Therefore, the groove 510 engages with the protrusion 520. When an external force is exerted on the sliding block 420 for pushing the sliding block 420 against the handle 100, the groove 510 disengages from the protrusion 520. When the external force stops exerting on the sliding block 420, a reposition force generated from the spring 610 is provided to the sliding block 420 for enabling the groove 510 to engage with the protrusion 520 again.

As mentioned above, when the groove 510 and the protrusion 520 are in a rectangular shape, it provides a better engagement effect. The groove 510 can be in a trapezoid shape, and the protrusion 520 can be in a trapezoid shape corresponding to the groove 510. When the groove 510 and the protrusion 520 are in a trapezoid shape, it provides a better engagement effect than in a serrated shape. It also enables the groove 510 to disengage from the protrusion 520 more easily than in a rectangular shape.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fail within the scope of the following claims.

What is claimed is:

1. A pivot head wrench, comprising:

a handle;

a head;

a pivot pin connecting the handle and the head;

a linear motion mechanism disposed at the handle and comprising a moving path, wherein the head is disposed in the moving path; and a lock mechanism comprising a groove and at least one protrusion, wherein the groove is in a rectangular shape, and the protrusion is in a rectangular shape corresponding to the groove, one of the groove and the protrusion is disposed at the head while the other is disposed at the linear motion mechanism for engaging with each other, and the protrusion and the groove both are disposed in the moving path.

2. A pivot head wrench, comprising:

a handle;

a head;

a pivot pin connecting the handle and the head;

a linear motion mechanism disposed at the handle and comprising a track and a sliding block, wherein the track has an extending path, the sliding block is disposed on the track, and the head is disposed in the extending path; and a lock mechanism comprising a groove and at least one protrusion, wherein the groove is in a rectangular shape, and the protrusion is in a rectangular shape corresponding to the groove, one of the groove and the protrusion is disposed at the head while the other is disposed at the sliding block for engaging with each other, and the protrusion and the groove both are disposed in the extending path.

3. The pivot head wrench of claim 2, further comprising:

a reposition mechanism comprising a spring and a recess, wherein the recess is disposed in the handle for accommodating the spring, and an end of the spring abuts against the sliding block of the linear motion mechanism.

* * * * *